US010424861B2

(12) United States Patent
Suzuki et al.

(10) Patent No.: US 10,424,861 B2
(45) Date of Patent: Sep. 24, 2019

(54) COAXIAL CONNECTOR WITH AN OUTER CONDUCTOR PART HAVING A REAR PLATE PART

(71) Applicant: Molex, LLC, Lisle, IL (US)

(72) Inventors: Teruhito Suzuki, Koza (JP); Yasuyuki Miki, Yamato (JP); Hiroyuki Yajima, Yamato (JP); Akinori Mizumura, Yokohama (JP)

(73) Assignee: Molex, LLC, Lisle, IL (US)

( * ) Notice: Subject to any disclaimer, the term of this patent is extended or adjusted under 35 U.S.C. 154(b) by 0 days.

(21) Appl. No.: 15/890,803

(22) Filed: Feb. 7, 2018

(65) Prior Publication Data

US 2019/0229452 A1 Jul. 25, 2019

(30) Foreign Application Priority Data

Jan. 19, 2018 (JP) ..... 2018-006916

(51) Int. Cl.
*H01R 12/00* (2006.01)
*H01R 13/41* (2006.01)
(Continued)

(52) U.S. Cl.
CPC ..... *H01R 13/41* (2013.01); *H01R 13/502* (2013.01); *H01R 13/6592* (2013.01); *H01R 24/50* (2013.01); *H01R 2103/00* (2013.01)

(58) Field of Classification Search
CPC ..... H01R 2103/00
(Continued)

(56) References Cited

U.S. PATENT DOCUMENTS 4,598,961 A * 7/1986 Cohen ..... H01R 24/50 439/581
5,334,050 A * 8/1994 Andrews ..... H01R 24/50 439/579
(Continued)

FOREIGN PATENT DOCUMENTS

CN 104241880 B 8/2016
JP H05-042630 U 6/1993
(Continued)

OTHER PUBLICATIONS

Notice of Allowance received for Korean application No. 10-2017-124793, dated Aug. 13, 2018, 2 pages. (1 page of English Translation and 1 page of Official copy).
(Continued)

*Primary Examiner* — Thanh Tam T Le
(74) *Attorney, Agent, or Firm* — Molex, LLC

(57) ABSTRACT

A conductor having a conductive terminal; an intermediate insulator housing the terminal; an outer conductor part that is an integrated molded product formed from a conductive metal plate housing the intermediate insulator; and a housing formed from an insulating material, which housing houses the outer conductor part; wherein the outer conductor part includes: a cylindrical main body part formed from a curved plate, a plate-like rear plate part electrically connected to a rear end of the main body part, which rear plate part closes the rear end of the main body part; and left and right leg parts extending downward from a cylindrical wall of the main body part, the rear plate part includes left and right anchor parts extending forward from left and right ends of the rear plate part, the housing includes slit-shaped left and right anchor housing parts extending forward, and the outer conductor part is housed in the housing, and each anchor
(Continued)

part is inserted into and retained by a corresponding anchor housing part.

4 Claims, 8 Drawing Sheets

(51) Int. Cl.
*H01R 24/50* (2011.01)
*H01R 13/502* (2006.01)
*H01R 13/6592* (2011.01)
*H01R 103/00* (2006.01)

(58) Field of Classification Search
USPC ..... 439/63, 579, 675, 580–582
See application file for complete search history.

(56) References Cited

U.S. PATENT DOCUMENTS 5,645,454 A * 7/1997 Kosmala ..... H01R 24/52 439/607.32
5,879,190 A 3/1999 Maruyama et al.
6,227,904 B1 * 5/2001 Wang ..... H01R 13/6583 439/541.5
7,086,867 B2 * 8/2006 Nakagawa ..... H01R 24/42 439/63
7,101,189 B1 * 9/2006 Huss ..... H01R 13/6272 439/357
7,137,825 B2 * 11/2006 Myer ..... H01R 23/6873 439/63
8,430,675 B2 * 4/2013 Hardy ..... H01R 24/50 439/607.36
8,602,831 B2 * 12/2013 Miyawaki ..... H01R 43/16 439/877
8,777,651 B2 * 7/2014 Miyawaki ..... H01R 13/6272 439/354
9,124,047 B2 * 9/2015 Kanda ..... H01R 13/6474
9,812,823 B2 * 11/2017 Kawakami ..... H01R 24/44

FOREIGN PATENT DOCUMENTS

JP H08-306435 A 11/1996
JP H11-224715 A 8/1999
JP 2005-038725 A 2/2005
JP 2009-064716 A 3/2009
JP 5140837 B2 2/2013
JP 2016-192717 A 11/2016
WO 00/16449 A1 3/2000

OTHER PUBLICATIONS

Notice of Allowance received for Japanese application No. 2016-192717, dated Dec. 26, 2017, 6 pages. (3 page of English Translation and 3 pages of Official copy).

* cited by examiner

COAXIAL CONNECTOR WITH AN OUTER CONDUCTOR PART HAVING A REAR PLATE PART

RELATED APPLICATIONS

This application claims priority to Japanese Application No. 2018-006916, filed Jan. 19, 2018, which is incorporated herein by reference in its entirety.

TECHNICAL FIELD

The present disclosure relates to a connector.

BACKGROUND ART

Conventionally, a connector where a periphery of a terminal is surrounded by a cylindrical shield is used to electrically connect a coaxial cable to a circuit board (for example, refer to Patent Document 1).

FIG. 8 is a cross-sectional view of a conventional connector.

In the figure, 811 is a connector housing mounted on a circuit board 891, which housing has a box-like shape, a front surface of which is open such that a counterpart connecting plug 901 can be inserted therein. Furthermore, 851 is an L-shaped terminal provided inside the housing 811. Moreover, an L-shaped inner shield 861 is attached inside the housing 811 so as to surround the terminal 851. Note that an insulator 821 is interposed between a center corner part of the terminal 851 and the inner shield 861, and a locking member 824 is fitted between the insulator 821 and the housing 811. Additionally, an outer shield 871 covers an outer circumference of the housing 811.

Patent Document 1: Japanese Unexamined Patent Application Publication No. H08-306435

SUMMARY

However, control of electrical characteristics of an overall transmission circuit including the terminal 851 and the inner shield 861 is inadequate in the aforementioned conventional connector. Because the terminal 851 and the inner shield 861 are integrated and function as a transmission circuit when a high-frequency signal is transmitted, electrical characteristics must be controlled so that impedance is stabilized over the entire transmission circuit without signal reflection or the like, occurring. However, in the aforementioned conventional connector, adequate consideration has not been given to controlling such electrical characteristics.

An object herein is to resolve the problems of the aforementioned conventional connector by providing a highly reliable connector that is easy to produce, has low manufacturing costs, and has good electrical characteristics over the entire transmission circuit.

Therefore, the connector includes: a conductive terminal; an intermediate insulator housing the terminal; an outer conductor part that is an integrated molded product formed from a conductive metal plate housing the intermediate insulator; and a housing formed from an insulating material, which housing houses the outer conductor part, wherein the outer conductor part includes: a cylindrical main body part formed from a curved plate, a plate-like rear plate part electrically connected to a rear end of the main body part, which rear plate part closes the rear end of the main body part; and left and right leg parts extending downward from a cylindrical wall of the main body part, the rear plate part includes left and right anchor parts extending forward from left and right ends of the rear plate part, the housing includes slit-shaped left and right anchor housing parts extending forward, the outer conductor part is housed in the housing, and each anchor part is inserted into and retained by a corresponding anchor housing part.

Furthermore, in another connector, the left and right anchor parts are parallel to the main body part and positioned and aligned to the left and right of the main body part, and a side wall part is positioned below the main body part.

Furthermore, in yet another connector, a square tube shaped base part is linked to a lower end of the rear plate part, the base part includes a flat plate shaped rear wall part linked to the lower end of the rear plate part, left and right side wall parts extending forward from left and right ends of the rear wall part, and protrusions formed on outer surfaces of the side wall parts, the outer surfaces of the left and right side wall parts face inner surfaces of the left and right leg parts, at least one of the protrusions of the side wall parts abuts the inner surface of an opposing leg part, and each of the side wall parts is in electrical contact with the opposing leg part.

Furthermore, in yet another connector, the protrusions are formed in a plurality of locations in the longitudinal direction of the side wall part.

According to the present disclosure, production is easy, manufacturing costs are low, electrical characteristics are good over an entire transmission circuit, and reliability can be improved.

BRIEF DESCRIPTION OF THE DRAWINGS

FIG. 1A is a view as seen obliquely from the front, and FIG. 1B is a view as seen obliquely from the rear.

FIG. 4A is an upper surface view, FIG. 4B is a rear surface view, FIG. 4C is a side surface view, FIG. 4D is a front surface view, and FIG. 4E is a lower surface view.

FIG. 5A is a cross-sectional view along the line indicated by arrows N-N in FIG. 4A, FIG. 5B is a cross-sectional view along the line indicated by arrows P-P in FIG. 4C, and FIG. 5C is a cross-sectional view along the line indicated by arrows R-R in FIG. 4C.

FIGS. 6A-6C are perspective views illustrating each step, and FIGS. 6D-6F are lower surface views corresponding to FIGS. 6A-6C, respectively.

FIG. 7A is a cross-sectional view along the line indicated by the arrows T-T in FIG. 4C, and FIG. 7B is an enlarged view of the part indicated by U in FIG. 7A.

DETAILED DESCRIPTION OF THE PREFERRED EMBODIMENTS

Embodiments are described in detail below with reference to the drawings.

Figure 1B:
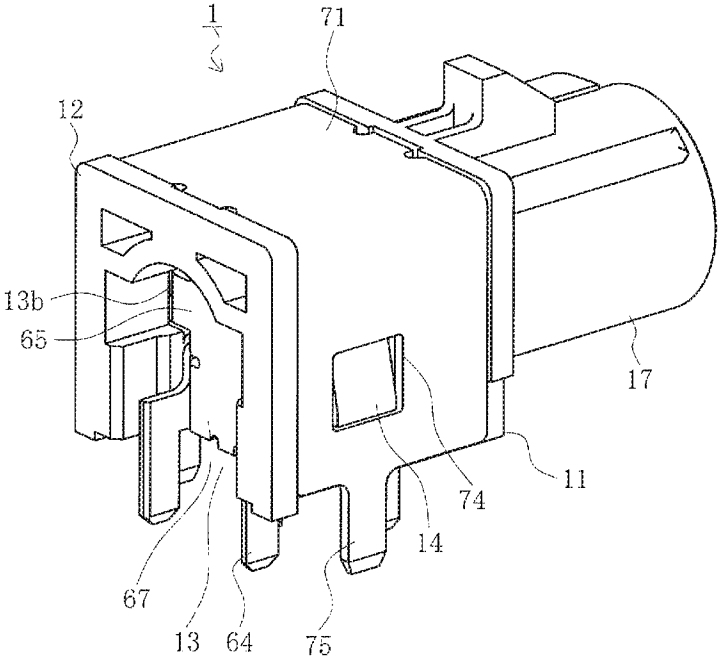
FIGS. 1A-1B are perspective views of a connector according to the present embodiment, where
Figure 1A:
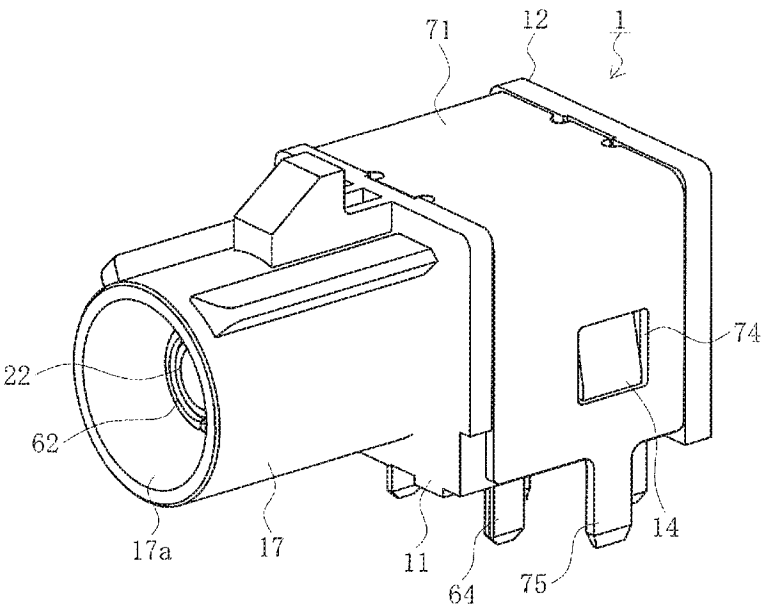
Figure 2:
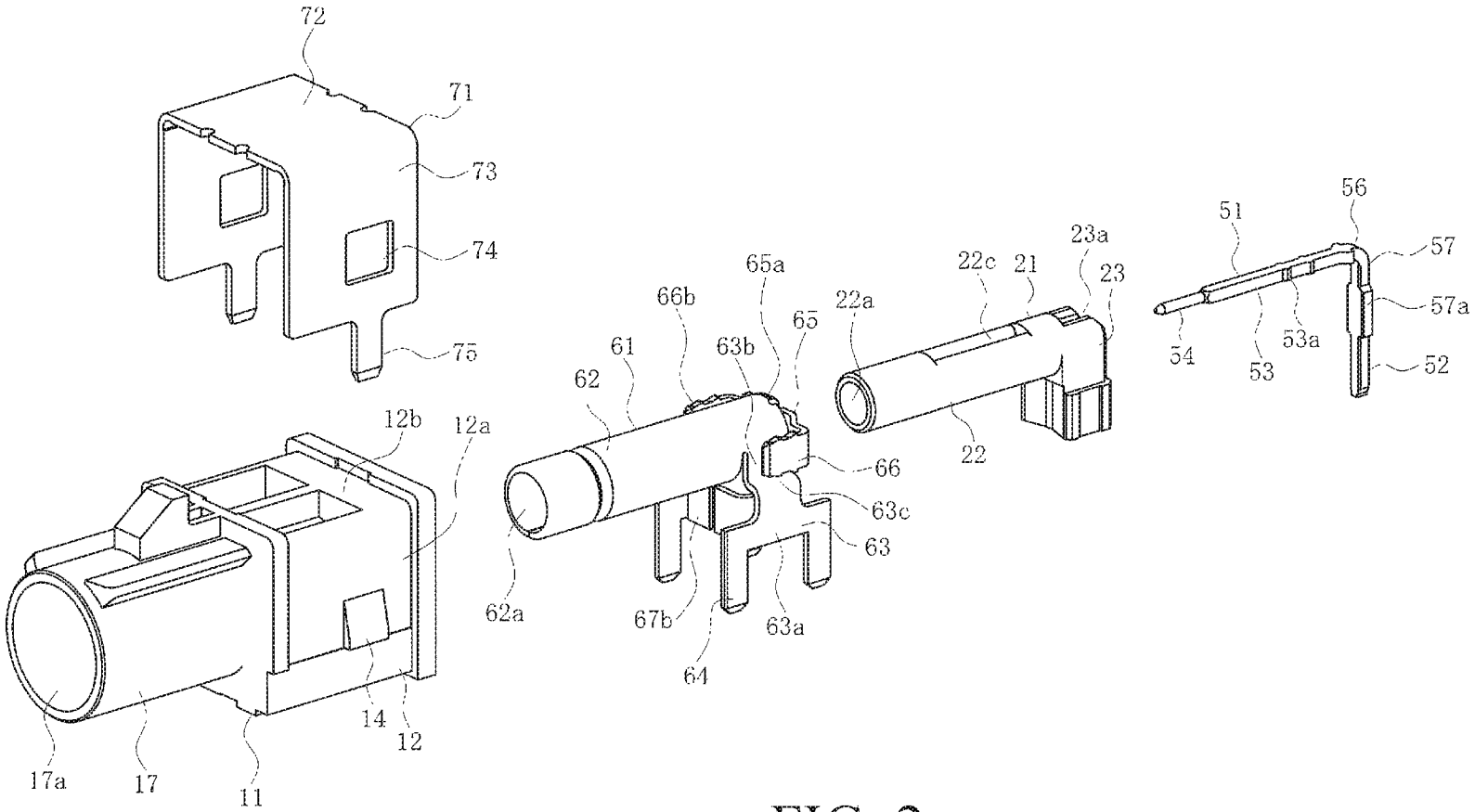
FIG. 2 is an exploded view of the connector according to the present embodiment as seen obliquely from the front.
Figure 3:
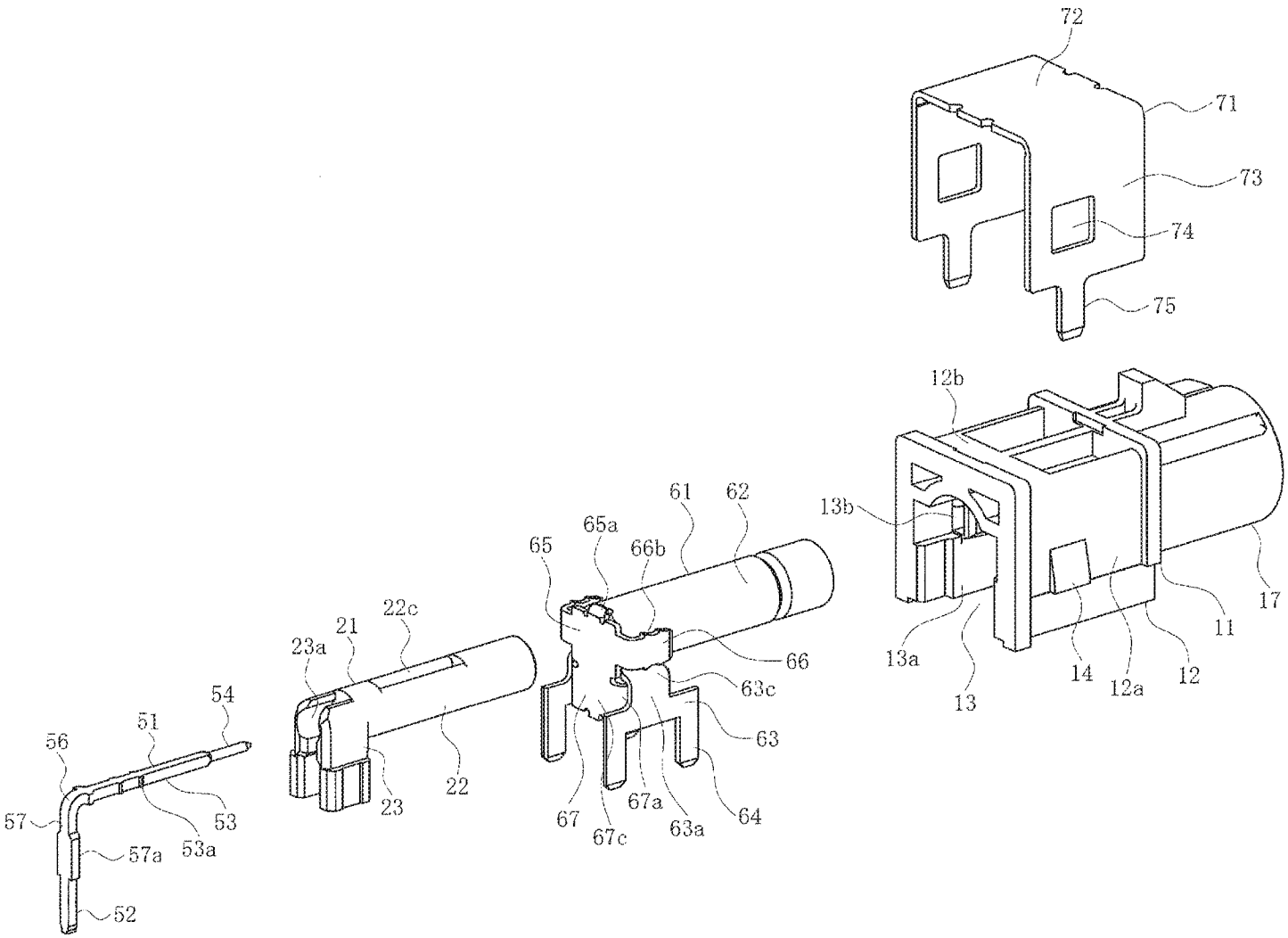
FIG. 3 is an exploded view of the connector according to the present embodiment as seen obliquely from the rear.
Figure 4A:
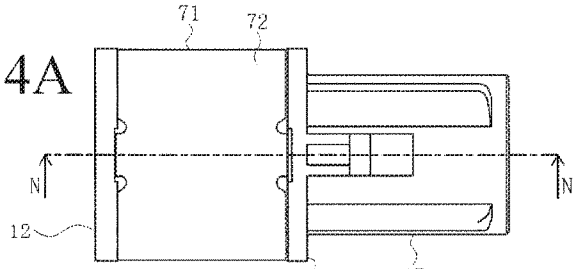
FIGS. 4A-4E include views of five sides of the connector according to the present embodiment, where
Figure 4C:
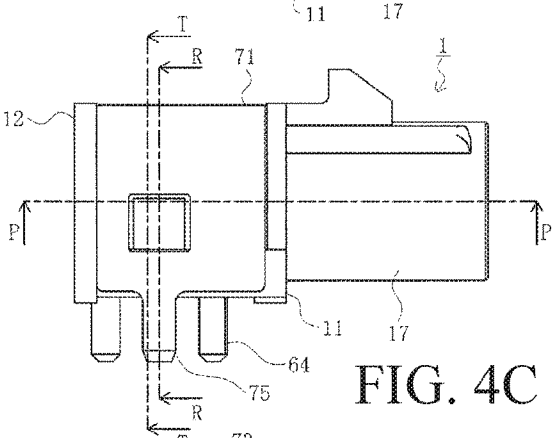
Figure 4D:
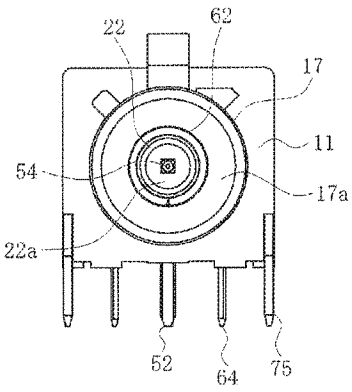
Figure 4E:
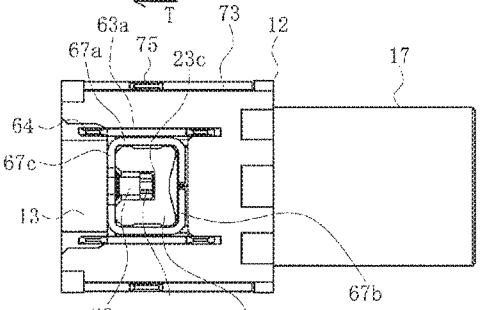
Figure 4B:
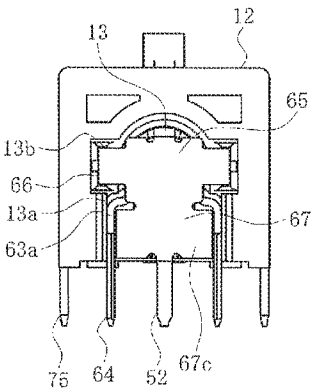
Figure 5A:
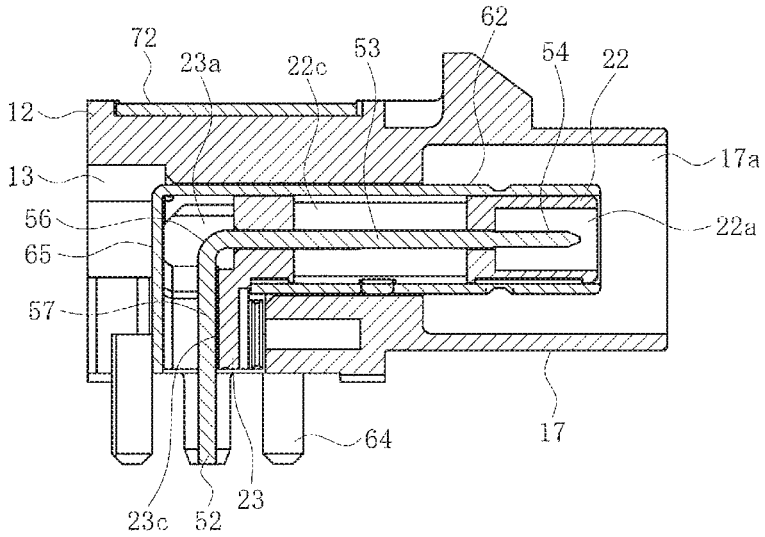
FIGS. 5A-5C is a cross-sectional view of the connector according to the present embodiment, where
Figure 5B:
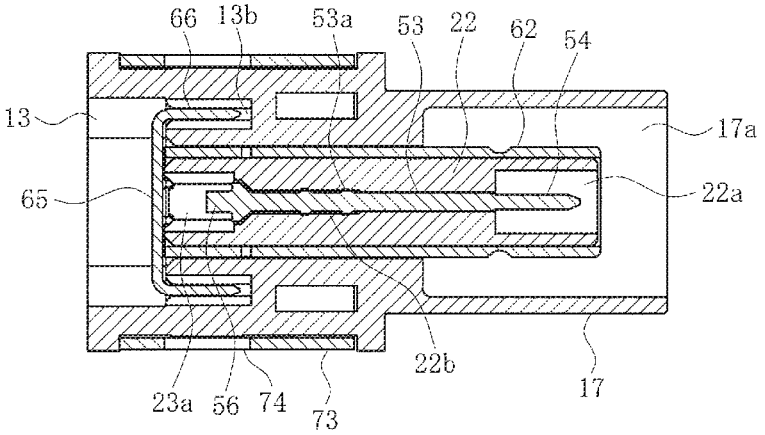
Figure 5C:
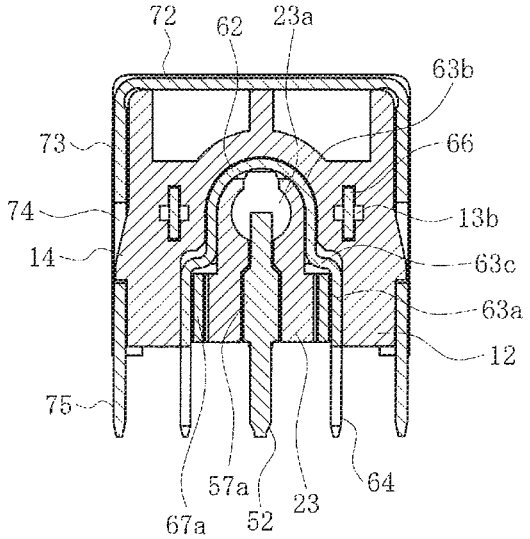

FIGS. 1A-1B are perspective views of a connector according to the present embodiment, FIG. 2 is an exploded view of the connector according to the present embodiment as seen obliquely from the front, FIG. 3 is an exploded view of the connector according to the present embodiment as seen obliquely from the rear, FIGS. 4A-4E include five side views of the connector according to the present embodiment, and FIGS. 5A-5C are cross-sectional views of the connector according to the present embodiment. Note that, FIG. 1A is a view as seen obliquely from the front, and FIG. 1B is a view as seen obliquely from the rear, FIG. 4A is an upper surface view, FIG. 4B is a rear surface view, FIG. 4C is a side surface view, FIG. 4D is a front surface view, and FIG. 4E is a lower surface view, and FIG. 5A is a cross-sectional view along the line indicated by arrows N-N in FIG. 4A, FIG. 5B is a cross-sectional view along the line indicated by arrows P-P in FIG. 4C, and FIG. 5C is a cross-sectional view along the line indicated by arrows R-R in FIG. 4C.

In the figures, 1 is a connector representing a cable connector according to the present embodiment, wherein the connector is used in a state of being mounted on a printed circuit board, a flexible circuit board, and the like, is used in electronic devices, electric devices, and the like, such as personal computers, mobile phones, smart phones, tablet terminals, automotive navigation devices, automotive audio devices, vehicle mounted cameras, gaming devices, and the like, and is used in a state where the connector is connected to a tip of a cable, such as a signal cable, or the like, not illustrated in the figures. Although the cable can be used in any type of device and can be any type of cable, the cable is described herein as a so-called coaxial cable where a periphery of a center conductor is covered by an outer conductor. Furthermore, although the connector 1 may be any type of connector, the connector is described herein as a so-called coaxial connector for connecting a coaxial cable, and thus the connector 1 is described as preferably being a coaxial connector conforming to the FAKRA standard.

Note that expressions for indicating directions such as up, down, left, right, front, back, and the like, used to describe the operations and configurations of the parts of the connector 1 according to the present embodiment are not absolute but rather relative directions, and though appropriate when the parts of the connector 1 are in the positions illustrated in the figures, the directions should be interpreted differently when the positions change so as to correspond to the changes.

The connector 1 includes; a housing 11 as a connector main body integrally formed using an insulating material such as a synthetic resin, or the like; an outer conductor part 61 housed inside the housing 11, which conductor part is a member formed by subjecting a conductive metal plate to processes such as punching, pressing, folding and bending, and the like; an intermediate insulator 21 housed inside the outer conductor part 61, which insulator is a member integrally formed using an insulating material such as a synthetic resin, or the like; a terminal 51 as a center conductor part housed inside the intermediate insulator 21, which terminal is a member integrally formed by subjecting a conductive metal plate to processes such as punching, pressing, folding and bending, and the like; and a shield 71 as an auxiliary fitting attached to a periphery of the housing 11, which shield is a member integrally formed by subjecting a conductive metal plate to processes such as punching, pressing, folding and bending, and the like.

The housing 11 includes a substantially parallelepiped-shaped mounting part 12 and a substantially cylindrical connecting part 17 extending forward from a front surface of the mounting part 12, and has a substantially L-shaped side surface form.

A lower surface of the mounting part 12 is a portion that is mounted and fixed to a mounting member facing a mounting surface of the mounting member, which mounting member is that of a circuit board, or the like. The mounting part 12 also includes flat left and right outer walls 12*a*, a flat upper wall 12*b* connected to upper ends of the outer walls 12*a*, and a shield engaging protrusion 14 protruding from each of the outer walls 12*a*.

Furthermore, the connecting part 17 is a portion where a coaxial cable not illustrated in the figures is connected and a cable insertion hole 17*a*, in which a tip of the coaxial cable is inserted, is formed. The cable insertion hole 17*a* is open on a front end surface of the connecting part 17 and extends in a longitudinal direction of the housing 11.

Meanwhile, an outer conductor housing part 13, which is a space for housing the outer conductor part 61, is formed in the mounting part 12. The outer conductor housing part 13 is open on the lower surface and a rear surface of the mounting part 12, and communicates with the cable insertion hole 17*a*. Note that the outer conductor housing part 13 includes flat left and right side surface parts 13*a* extending forward, and a slit-shaped anchor housing part 13*b* extending forward. The side surface parts 13*a* are portions that face left and right lower leg parts 63*a* of a leg part 63 of the outer conductor part 61, and the anchor housing part 13*b* is a portion into which an anchor part 66 of the outer conductor part 61 is inserted and housed.

The shield 71 includes a flat top plate part 72, flat side plate parts 73 extending downward from left and right ends of the top plate part 72, an engaging opening 74 formed in the side plate part 73, and a shield tail part 75 protruding downward from a lower end of the side plate part 73. Furthermore, the shield 71 is moved downward with respect to the housing 11 from the position illustrated in FIG. 2 and FIG. 3 and is attached to the periphery of the housing 11 as illustrated in FIGS. 1A and 1B so as to be covered by a periphery of the mounting part 12. The shield 71 attached to the periphery of the housing 11 is effectively prevented from being removed from the housing 11 because the engaging opening 74 engages with the shield engaging protrusion 14 of the mounting part 12. Moreover, in a state where the shield 71 is attached to the housing 11, the shield tail part 75 is plugged into an opening formed in the mounting surface of the mounting member, such as a through hole, a via hole, or the like, and is then connected and fixed to the opening by connecting means such as soldering, or the like. This fixes the housing 11 to the mounting surface of the mounting member. Note that it is preferable that the opening be connected to a ground trace such as a ground wire, or the like.

The terminal 51 has a substantially L-shaped side surface form and includes; a long, thin rod-shaped main body part 53 extending in the longitudinal direction of the housing 11; a long, thin rod-shaped base part 57 extending in a vertical direction of the housing 11; and a curved part 56 linking the main body part 53 and the base part 57. Furthermore, a small diameter cylindrical contact part 54 electrically connected to a core wire of a coaxial cable is formed on a tip of the main body part 53. Moreover, the base part 57 includes a tail part 52 protruding downward from a lower end of the base part. The tail part 52 is plugged into an opening such as a through hole, a via hole, or the like, formed in the mounting surface of the mounting member, and is then electrically connected and fixed to the opening by connecting means such as soldering, or the like. The opening is connected to a conductive trace such as a signal wire, or the like. Additionally, a retaining protrusion 53*a* that bites into and is retained in a wall surface of a terminal insertion hole 22*b* of an intermediate insulator 21 is formed on a side surface of the main body part 53, and a retaining convex part 57*a* that bites into and is retained in a wall surface of a terminal retaining groove 23*c* of the intermediate insulator 21 is formed in a side surface of the base part 57.

The intermediate insulator 21 has a substantially L-shaped side surface form, and includes; a main body part 22 that extends in the longitudinal direction of the housing 11 and has a columnar outer shape, and a base part 23 extending in a vertical direction of the housing 11. The main body part 22 includes; a large diameter contact part housing hole 22*a*, which is a space that is open on a tip thereof and houses the contact part 54 of the terminal 51; and a terminal insertion hole 22*b*, which is a space for retaining the retaining protrusion 53*a* of the terminal 51 and communicates with a rear end of the contact part housing hole 22*a*. Note that an adjustment space 22*c* for adjusting a dielectric constant of a space between the outer conductor part 61 and the terminal 51 is formed in a portion where the contact part housing hole 22*a* and the terminal insertion hole 22*b* are linked. The adjustment space 22*c* is a portion where there is no insulating material. Furthermore, the base part 23 includes a base part housing part 23*a*, which is a space housing the base part 57 of the terminal 51. The base part housing part 23*a* is open on an upper surface, a lower surface, and a rear surface of the base part 23, and communicates with the terminal insertion hole 22*b*. Furthermore, the base part housing part 23*a* includes a terminal retaining groove 23*c*, which retains the retaining convex part 57*a* of the terminal 51.

Furthermore, the terminal 51 is moved forward relative to the intermediate insulator 21 from the position illustrated in FIG. 2 and FIG. 3 and is housed inside the intermediate insulator 21, such that the contact part 54 is housed inside the contact part housing hole 22*a*, the retaining protrusion 53*a* is retained inside the terminal insertion hole 22*b*, and the retaining convex part 57*a* is retained inside the terminal retaining groove 23*c*, as illustrated in FIGS. 4A-4E and FIGS. 5A-5C. In this state, the tail part 52 of the terminal 51 protrudes downward from a lower surface of the base part 23 of the intermediate insulator 21.

The outer conductor part 61 includes; a cylindrical main body part 62 formed from a curved plate, which plate extends in the longitudinal direction of the housing 11; left and right leg parts 63 extending in the vertical direction of the housing 11; a square tube shaped base part 67 extending in the vertical direction of the housing 11; a rear plate part 65 that links an upper end of the main body part 62 and an upper end of the base part 67 and closes a rear end of the main body part 62; and a bending part 65*a* linking an upper end of the rear plate part 65 and the upper end of the main body part 62. A cylindrical portion formed from the cylindrical main body part 62 and the square tube shaped base part 67 has a substantially L-shaped side surface form. The main body part 62 includes a main body space part 62*a* extending from a tip to the rear end of the main body part 62, which body space part is a space housing the main body part 22 of the intermediate insulator 21. Note that a rear end of the main body space part 62*a* is closed by the rear plate part 65.

The leg part 63 includes an upper leg part 63*b* extending straight downward from a cylindrical wall near the rear end of the main body part 62, and a lower leg part 63*a* extending straight downward and linked to a lower end of the upper leg part 63*b* through a bent part 63*c*. The bent part 63*c*, when viewed from the front or rear, is a portion bent in a crank shape and thus, a distance between the left and right upper leg parts 63*b* is approximately the same as a diameter of the cylindrical main body part 62 while a distance between the left and right lower leg parts 63*a* is larger than the diameter of the main body part 62. Note that each of the lower leg parts 63*a* includes a pair of outer tail parts 64 protruding downward from front and rear ends of the lower leg parts. The outer tail part 64 is plugged into an opening such as a through hole, a via hole, or the like, formed in the mounting surface of the mounting member, and is then electrically connected and fixed to the opening by connecting means such as soldering, or the like. The opening is connected to a ground trace such as a ground wire, or the like.

Furthermore, a pair of the plate-shaped anchor parts 66 that extend forward are connected to left and right side edges of the rear plate part 65. The anchor part 66 is a portion inserted into and housed in the anchor housing part 13*b* of the housing 11, and a retaining protrusion 66*b* that bites into and is retained in a wall surface of the anchor housing part 13*b* is formed in upper and lower side surfaces of the anchor part 66. Note that the left and right anchor parts 66 are positioned outside of the upper leg part 63*b*.

The base part 67 includes; a flat plate shaped rear wall part 67*c* linked to a lower end of the rear plate part 65; a pair of plate-shaped side wall parts 67*a* linked to left and right side edges of the rear wall part 67*c* and extending forward; and a pair of plate-shaped front wall parts 67*b* linked to a front end of each side wall part 67*a*, which front wall parts extend toward the side wall parts 67*a* on mutually opposite sides. Note that mutual opposing tips of the pair of front wall parts 67*b* either abut one another or are in close proximity to one another. Furthermore, the left and right side wall parts 67*a* are positioned inside of the lower leg part 63*a*, and at least one part thereof makes contact with the lower leg part 63*a*, and is in electrical contact with the lower leg part 63*a*.

The intermediate insulator 21 housing the terminal 51 is moved forward relative to the outer conductor part 61 from the position illustrated in FIG. 2 and FIG. 3, and is thus housed inside the outer conductor part 61. In this case, as is described later, the bending part 65*a* is still not bent, the rear plate part 65 and the base part 67 extend backward horizontally from the upper end of the main body 62, and the rear end of the main body part 62 is open. In this state, the intermediate insulator 21 housing the terminal 51 can be advanced relatively frontward from behind the outer conductor part 61, and housed inside the outer conductor part 61. Furthermore, as is described later, after the main body part 22 of the intermediate insulator 21 is housed inside the main body part 62 of the outer conductor part 61, and the base part 23 of the intermediate insulator 21 is positioned between the left and right leg parts 63 of the outer conductor part 61, the bending part 65*a* is bent, the rear end of the main body part 62 is closed, and the pair of side wall parts 67*a* are bent to form the base part 67 into a square tube shape, causing the intermediate insulator 21 housing the terminal 51 to be housed inside the outer conductor part 61, as illustrated in FIGS. 4A-4E and FIGS. 5A-5C.

Furthermore, the outer conductor part 61 housing the intermediate insulator 21 housing the terminal 51 is moved forward relative to the housing 11 from the position illustrated in FIG. 2 and FIG. 3, and is thus housed inside the housing 11. Specifically, at least a portion in the vicinity of a front end of the main body part 62 is housed inside the cable insertion hole 17*a*, and portions such as the leg part 63, the rear plate part 65, the base part 67, and the like, are housed inside the outer conductor housing part 13. Moreover, the left and right anchor parts 66 are inserted into the slit-shaped anchor housing parts 13*b*, and the retaining protrusion 66*b* bites into and is retained in the wall surface of the anchor housing part 13*b*. In this state, the tail part 52 of the terminal 51 and the outer tail part 64 of the outer conductor part 61 protrude downward from the lower surface of the outer conductor housing part 13, similar to the shield tail part 75.

The method for assembling the outer conductor part 61 is described next.

Figure 6A:
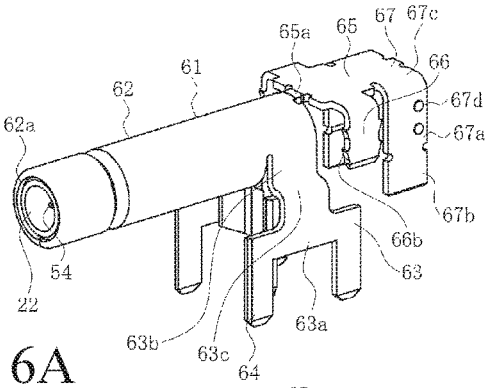
FIGS. 6A-6F include views illustrating steps for assembling a rear half part of an outer conductor part of the connector according to an embodiment of the present disclosure, where
Figure 6D:
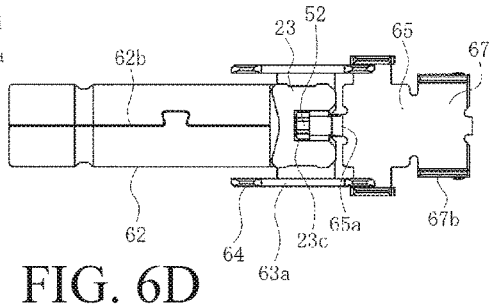
Figure 6B:
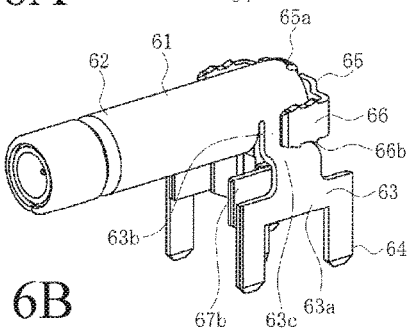
Figure 6E:
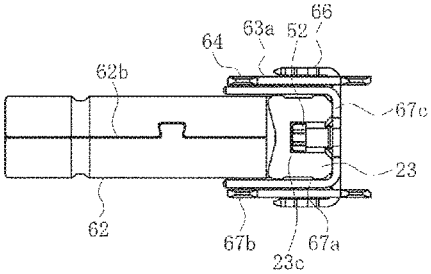
Figure 6C:
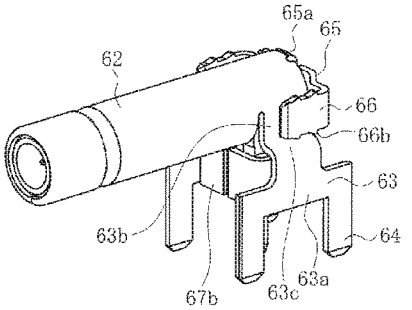
Figure 6F:
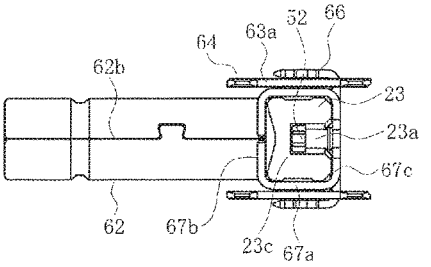
Figure 7B:
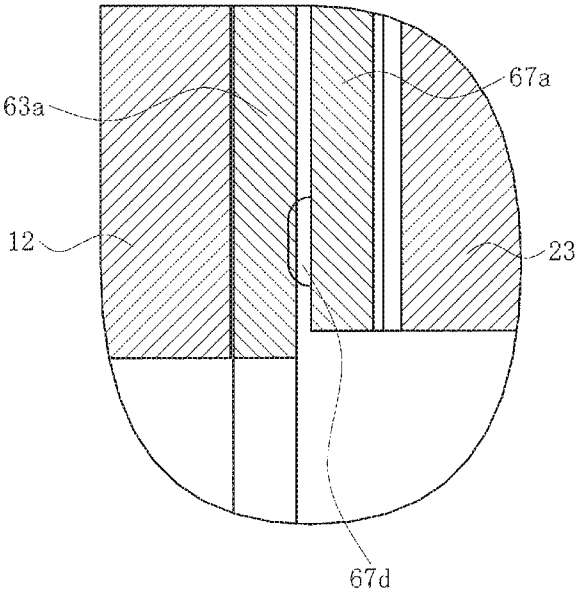
FIGS. 7A-7B are cross-sectional views for describing the rear half part of the outer conductor part of the connector according to the present embodiment in an assembled state, where
Figure 7A:
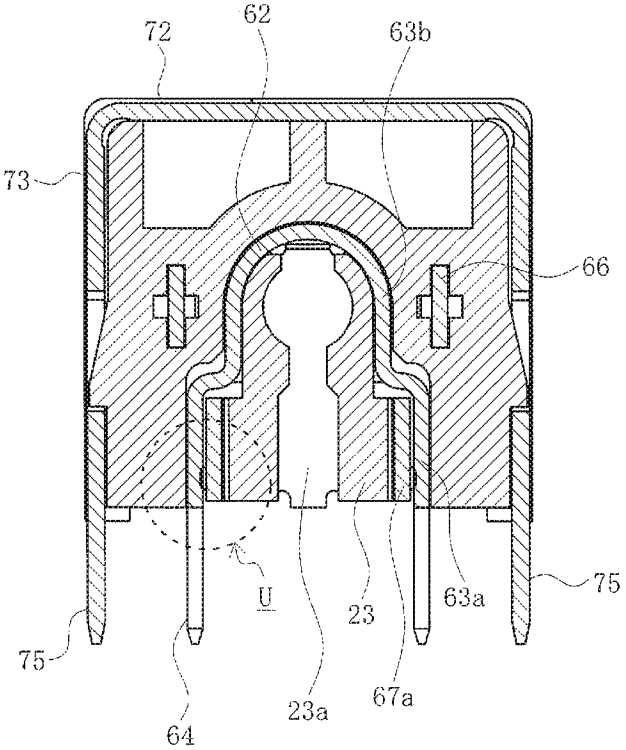
Figure 8:
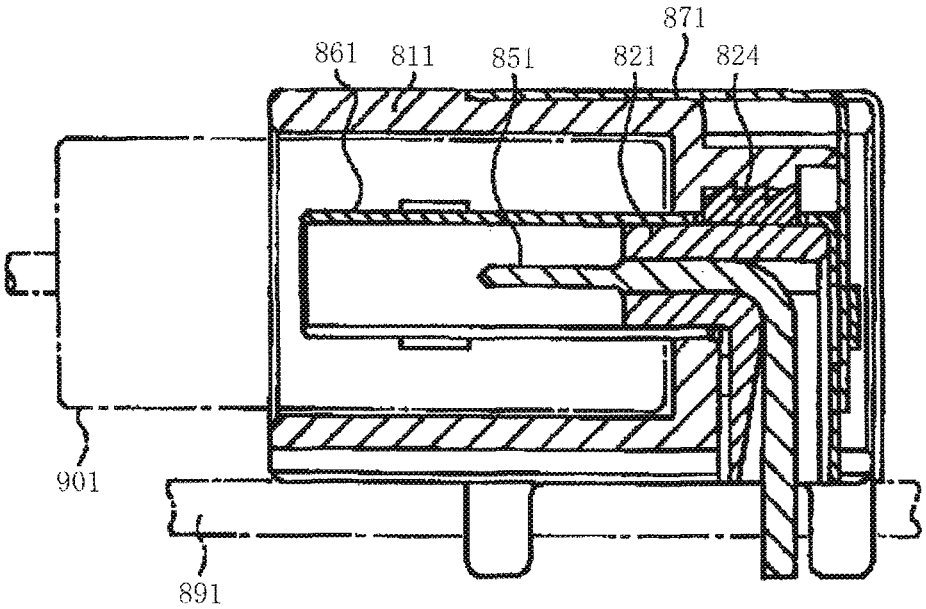
FIG. 8 Prior Art
FIG. 8 is a cross-sectional view of a conventional connector.

FIGS. 6A-6F are views illustrating steps for assembling a rear half part of an outer conductor part of a connector of an embodiment according to the present disclosure, and FIGS. 7A-7B are cross-sectional views for describing the rear half part of the outer conductor part of the connector of an embodiment according to the present embodiment in an assembled state. Note that, FIGS. 6A-6C are perspective views illustrating each step, and FIGS. 6D-6F are lower surface views corresponding to FIGS. 6A-6C, respectively, and FIG. 7A is a cross-sectional view along the line indicated by the arrows T-T in FIG. 4C, and FIG. 7B is an enlarged view of the part indicated by U in FIG. 7A.

In the present embodiment, the outer conductor part 61 is, for example, a member formed by punching a flat plate shaped thin metal plate and then folding and bending a plate material into a prescribed outline and shape. Specifically, a portion corresponding to a flat plate having a prescribed outline and shape is bent into a cylindrical shape, mutually opposing ends thereof are caused to abut and join to form the main body part 62 including a joined part 62*b* extending in the longitudinal direction as illustrated in FIGS. 6D-6F.

At this time, the bent part 63*c* is formed by bending a part of the leg part 63, and a portion equating to a cylindrical wall is bent so as to extend downward from the cylindrical wall in the vicinity of the rear end of the main body part 62. Furthermore, the pair of anchor parts 66 are folded and bent so as to be nearly orthogonal to the rear plate part 65, and the pair of side wall parts 67*a* are folded and bent so as to be nearly orthogonal to the rear wall part 67*c*. Note that because the bending part 65*a* is still not bent, as is illustrated in FIG. 6A and FIG. 6D, the rear plate part 65 and the rear wall part 67*c* of the base part 67 are positioned extending horizontally backward from the upper end of the main body part 62. Accordingly, the rear end of the main body part 62 is open.

Furthermore, a protrusion 67*d* that protrudes outward is formed through press molding on the outer surface of the side wall part 67*a* in advance. The purpose of the protrusion 67*d* is to bite into the inner surface of a corresponding lower leg part 63*a* when the outer conductor part 61 is completed so that each side wall part 67*a* makes reliable contact with a corresponding lower leg part 63*a* to thereby ensure a conductive state. Note that although two of the protrusions 67*d* are formed in each of the side wall parts 67*a* in the example illustrated in FIG. 6A, the number of the protrusions 67*d* may also be one or three or more, and, the protrusions may be formed in any location on the side wall part 67*a*. That is, at least one of the protrusions 67*d* must be formed on each of the side wall parts 67*a*.

The protrusion 67*d* may be a smooth protrusion as illustrated in the figures, a cut and raised protrusion with edges, or a protrusion having a flat surface part formed by half blanking.

Furthermore, the intermediate insulator 21 is housed inside the outer conductor part 61, as illustrated in FIG. 6A and FIG. 6D, by moving the intermediate insulator 21 housing the terminal 51 forward relative to the outer conductor part 61 from behind the outer conductor part 61 while the rear end of the main body part 62 is open. In this state, the main body part 22 of the intermediate insulator 21 is housed inside the main body part 62 of the outer conductor part 61, and the base part 23 of the intermediate insulator 21 is positioned between the left and right leg parts 63 of the outer conductor part 61.

Next, the bending part 65*a* linking the upper end of the main body part 62 of the outer conductor part 61 and the upper end of the rear plate part 65 is folded and bent, as illustrated in FIG. 6B and FIG. 6E, so that the rear plate part 65 extends downward orthogonal to an axial direction of the cylindrical main body part 62. Thus, the rear end of the main body part 62 is closed by the rear plate part 65 and the rear surface of the base part 23 of the intermediate insulator 21 is covered by the rear plate part 65 and the rear wall part 67*c*. Furthermore, the left and right side wall parts 67*a* penetrate between the left and right lower leg parts 63*a*, and the left and right anchor parts 66 are positioned on the outside of the left and right upper leg parts 63*b*.

Next, a linking part between the side wall part 67*a* and the front wall part 67*b* is folded and bent, as illustrated in FIG. 6C and FIG. 6F, so that the front wall part 67*b* linked to a front end of the side wall part 67*a* is orthogonal to the side wall part 67*a* extending toward the side wall part 67*a* on the opposite side. Thus, the base part 67 of the outer conductor part 61 forms a square tube extending downward from the main body part 62, a front surface of the base part 23 of the intermediate insulator 21 is covered by the front wall part 67*b*, and a portion below the main body part 22 in the base part 23 of the intermediate insulator 21 is housed in the square tube shaped base part 67 of the outer conductor part 61 such that a periphery of the part is covered by the side wall part 67*a*, the front wall part 67*b*, and the rear wall part 67*c* of the base part 67.

Furthermore, the outer conductor part 61 forms a portion that, excluding the outer tail part 64 protruding downward from the lower surface of the base part 23 of the intermediate insulator 21, forms a continuous conductor cylinder. Specifically, the main body part 62 is a cylinder over the entire length thereof and the base part 67 extending downward from the main body part 62 is a square tube, and a linking portion between the cylinder and the square tube is closed by the rear plate part 65 and the leg part 63. Therefore, the rod-shaped terminal 51 housed inside the intermediate insulator 21 protrudes downward from the lower surface of the base part 23 of the intermediate insulator 21, as illustrated in FIGS. 5A-5C. Accordingly, the combination of the terminal 51 and the outer conductor part 61 effectively functions as a transmission line transmitting high-frequency signals, and thus impedance can be maintained in a stable state over the entirety of the transmission line.

Furthermore, because the anchor part 66 is formed in the rear plate part 65 so as to be positioned outside of the upper leg part 63*b*, there is no need to form an anchor in the base part 67 forming the main body part 62 of the outer conductor part 61 and the square tube, thus making it easy to form a continuous conductor cylinder from the outer conductor part 61.

Incidentally, because the base part 67, particularly the side wall part 67*a* and the front wall part 67*b*, of the outer conductor part 61 is connected through the narrow bending part 65*a* to a distal end of the rear plate part 65 connected to the rear end of the main body part 62, as illustrated in FIG. 6A, a conductive path is far from the main body part 62. Therefore, if conduction between the side wall part 67*a* and the lower leg part 63*a* is blocked in a case where the protrusion 67*d* has not been formed, high-frequency signals from the main body part 62 that are reflected by the tip of the front wall part 67*b* through a long conductive path so as to return to the main body part 62 back through the long conductive path can have a significant impact on the high-frequency signals flowing through the main body part 62. Furthermore, a case where high-frequency signals that have been reflected so as to return to the main body part 62 through the long conductive path are reflected by the narrow bending part 65*a* and thus are once again reflected by the tip of the front wall part 67*b* so as to return to the main body part 62 can also have a significant impact on high-frequency signals flowing through the main body part 62. In such cases, the impedance of the transmission line formed from the terminal 51 and the outer conductor part 61 becomes unstable.

However, because the protrusion 67*d* is formed in the side wall part 67*a* protruding outward in the present embodiment, and the protrusion 67*d* bites into the inner surface of the corresponding lower leg part 63*a* as illustrated in FIG. 7B, each of the side wall parts 67*a* and the corresponding lower leg parts 63*a* make reliable contact to thus ensure a conductive state. Accordingly, the impedance of the transmission circuit formed from the terminal 51 and the outer conductor part 61 is stably maintained because the reflection of high-frequency signals as described above is effectively prevented from occurring in the base part 67.

Making the protrusion 67*d* a protrusion with edges, as described above, ensures that the protrusion bites more reliably into the side wall part 67*a*.

Note that although the anchor part 66, which is the portion that is inserted into and retained by the anchor housing part 13*b* of the housing 11, is a member that extends forward similar to the side wall part 67*a* and the front wall part 67*b*, the anchor part is in closer proximity to the bending part 65*a* than are the side wall part 67*a* and the front wall part 67*b*, as illustrated in FIG. 6A. Therefore, because the conductive path is not far from the main body part 62, there is very little possibility that the distance will have a significant impact on the high-frequency signals flowing through the main body part 62, even if the high-frequency signals from the main body part 62 are reflected by a tip of the anchor part 66.

Generally, a dielectric constant between a center conductor part and an outer conductor in a transmission line formed from a rod-shaped center conductor part, like the terminal 51, and a cylindrical outer conductor, like the outer conductor part 61, has a significant impact on impedance characteristics. In the present embodiment, as described above, the adjustment space 22*c* for adjusting a dielectric constant of a space between the outer conductor part 61 and the terminal 51 is formed in the intermediate insulator 21. The dielectric constant of the space between the outer conductor part 61 and the terminal 51 can be adjusted by appropriately adjusting the position, shape, size, and the like, of the adjustment space 22*c*, thus allowing the impedance properties of the transmission line formed from the terminal 51 and the outer conductor part 61 to be controlled.

Therefore, in the present embodiment, the connector 1 includes: the conductive terminal 51; the intermediate insulator 21 housing the terminal 51; and the outer conductor part 61, which is an integrated molded product formed from a conductive metal plate housing the intermediate insulator 21. Furthermore, the outer conductor part 61 includes: the cylindrical main body part 62 formed from a bent plate; the flat plate shaped rear plate part 65 linked to the rear end of the main body part 62 through the bending part 65*a* and which closes the rear end of the main body part 62; the square tube shaped base part 67 linked to the lower end of the rear plate part 65; and the left and right leg parts 63 extending downward from the cylindrical wall of the main body part 62; wherein, the base part 67 includes: the flat plate shaped rear wall part 67*c* linked to the lower end of the rear plate part 65; the left and right side wall parts 67*a* extending forward from the left and right ends of the rear wall part 67*c*; and the protrusion 67*d* formed on the outer surface of the side wall part 67*a*; and the outer surfaces of the left and right side wall parts 67*a* face the inner surfaces of the left and right leg parts 63, at least one of the protrusions 67*d* of each of the side wall parts 67*a* abuts the inner surface of the corresponding leg part 63, and thus each of the side wall parts 67*a* is conductive with the corresponding leg part 63.

Therefore, the impedance of the transmission line formed from the terminal 51 and the outer conductor part 61 is stably maintained because the side wall part 67*a*, where the conductive path from the rear end of the main body part 62 is long, is directly conductive with the leg part 63. Furthermore, the outer conductor part 61 can be produced easily at low cost because the outer conductor part 61 can be integrally molded into a complex shape by subjecting a conductive metal plate to processes such as punching, pressing, folding and bending, and the like. Accordingly, the highly reliable connector 1 with good electrical characteristics over an entire transmission circuit can be produced easily with low manufacturing costs.

Furthermore, the protrusion 67*d* is formed in a plurality of locations in the longitudinal direction of the side wall part 67*a*. Accordingly, the side wall part 67*a* and the leg part 63 can be more reliably maintained in a conductive state.

Additionally, the connector 1 also includes the housing 11, which is formed from an insulating material and houses the outer conductor part 61. The housing 11 includes the slit-shaped left and right anchor housing parts 13*b*, which extend forward, the outer conductor part 61 includes the left and right anchor parts 66, which extend forward from the left and right ends of the rear plate part 65, the outer conductor part 61 is housed in the housing 11, and each anchor part 66 is inserted into and retained by the corresponding anchor housing part 13*b*. Accordingly, the outer conductor part 61 housing the terminal 51 and the intermediate insulator 21 is stably housed and retained inside the housing 11, and is thus effectively prevented from coming out of the housing 11.

Furthermore, the left and right anchor parts 66 are parallel to the main body part 62 positioned and aligned to the left and right of the main body part 62, and the side wall part 67*a* is positioned below the main body part 62. Therefore, the outer conductor part 61 is stably housed and retained inside the housing 11 such that the outer conductor part 61 does not come out of the housing 11, even if oblique directional force is applied to the terminal 51 or the outer conductor part 61 when the coaxial cable connector 1 is inserted or removed.

Moreover, because the conductive path is not far from the main body part 62, the anchor part 66 does not have an impact on the electrical characteristics of the transmission circuit.

Additionally, the intermediate insulator 21 includes the adjustment space 22*c* that is able to adjust the dielectric constant of the space between the outer conductor part 61 and the terminal 51. Accordingly, the impedance characteristics of the transmission line formed from the terminal 51 and the outer conductor part 61 can be appropriately controlled.

Note that the disclosure according to the present specification describes features relating to preferred and exemplary embodiments. Various other embodiments, modifications, and variations within the scope and spirit of the claims appended hereto are obviously conceivable by persons skilled in the art based on a detailed overview of the disclosure according to the present specification.

The present disclosure can be applied to a connector.

The invention claimed is:

1. A connector comprising:

a conductive terminal;

an intermediate insulator housing the terminal;

an outer conductor part that is an integrated molded product formed from a conductive metal plate housing the intermediate insulator, the outer conductor part having a cylindrical main body part, a plate-like rear plate part, left and right leg parts and a square tube shaped base part, the cylindrical main body part being formed from a curved plate, the plate-like rear plate part being electrically connected to a rear end of the main body part, the rear plate part closes the rear end of the main body part, the left and right leg parts extending downward from left and right sides, respectively, of a cylindrical wall of the main body part, the rear plate part includes left and right anchor parts extending forward from left and right ends of the rear plate part, the square tube shaped base part being linked to a lower end of the rear plate part, the base part includes a flat plate shaped rear wall part linked to the lower end of the rear plate part, left and right side wall parts extending forward from left and right ends of the rear wall part, and a protrusion formed on an outer surface of each of the side wall parts, the outer surfaces of the left and right side wall parts face inner surfaces of the left and right leg parts, the protrusion of the left side wall part abuts the inner surface of the left leg part such that the left side wall part is in electrical contact with the left leg part, and the protrusion of the right side wall part abuts the inner surface of the right leg part such that the right side wall part is in electrical contact with the right leg part; and a housing formed from an insulating material, the housing houses the outer conductor part, the housing includes slit-shaped left and right anchor housing parts extending forward, each anchor part being inserted into and retained by a corresponding anchor housing part.

2. The connector according to claim 1, wherein each side wall part has a plurality of protrusions formed in a plurality of locations in a longitudinal direction of the side wall part.

3. The connector according to claim 1, wherein the rear plate part has a bending part, the bending part linking the rear plate part to the main body part, the bending part configured to be bent to change a position of the rear plate part relative to the main body part.

4. The connector according to claim 1, wherein the left and right anchor parts are parallel to the main body part and are positioned and aligned to the left and right of the main body part, and wherein the outer conductor has a side wall part that is positioned below the main body part.

* * * * *